US006616112B1

(12) United States Patent
Tseng

(10) Patent No.: US 6,616,112 B1
(45) Date of Patent: Sep. 9, 2003

(54) SUSPENSION DEVICE FOR A CEILING LAMP

(76) Inventor: Ming-Chi Tseng, No 18, Chen Hsing Tung Street, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/291,488

(22) Filed: Nov. 12, 2002

(51) Int. Cl.[7] ..... B42F 13/00
(52) U.S. Cl. ..... 248/342; 248/323; 439/537
(58) Field of Search ..... 248/342, 323, 248/317, 321, 320; 403/6, 315, 316, 376; 439/576, 537

(56) References Cited

U.S. PATENT DOCUMENTS 3,022,034 A * 2/1962 Purdy ..... 248/342
4,410,160 A * 10/1983 Alperin et al. ..... 248/674
6,176,736 B1 * 1/2001 Hsu ..... 439/537
6,305,974 B1 * 10/2001 Tseng ..... 439/537

* cited by examiner

*Primary Examiner*—Leslie A. Braun
*Assistant Examiner*—A. Joseph Wujciak
(74) *Attorney, Agent, or Firm*—Rosenberg, Klein & Lee

(57) ABSTRACT

A suspension device for a ceiling lamp includes a tubular body connected to a base member of the ceiling lamp and a shaft having a first end received in the tubular body and a second end connected to a lamp set. A through hole is defined in the tubular body and two P-shaped channel defined in an inner periphery of the through hole. Two blocking plates are located in the P-shaped channel. Two protrusions are diametrically extending from the shaft and selectively engaged between the two blocking plates to hold the shaft in place in the tubular body.

5 Claims, 6 Drawing Sheets

SUSPENSION DEVICE FOR A CEILING LAMP

BACKGROUND OF THE INVENTION

1. Field of the Invention

The present invention relates to a suspension device, and more particularly to suspension device for a ceiling lamp.

2. Description of Related Art

A conventional suspension device for a ceiling lamp in accordance with the prior art usually comprises base member adapted to be mounted to a frame that is secured to a ceiling or a bottom of a ceiling fan. A tubular body is centrally and perpendicularly mounted on to the base member. A through hole is centrally and longitudinally defined in the tubular body. Two longitudinal channels are diametrically defined in a periphery of the through hole. Two lateral channels are defined in the periphery of the through hole. Each lateral channel includes a first end communicating with the longitudinal channel and a second end having an indentation defined to communicate with the lateral channel. Two electrode plates are inserted into the top of the tubular body and partially extend into the through hole. The two electrode plates are electrically connected to a power source.

A shaft is detachably connected to the tubular body. The shaft includes a first end inserted into and selectively fixed in the tubular body and a second connected to a lamp set. Two protrusions diametrically extend from the shaft near the first end of the shaft. The two protrusions are respectively moved in the channels in the tubular body. Two electrode poles are inserted into the first end of the shaft and diametrically correspond to each other. Each electrode pole electrically abuts a corresponding one of the two electrode plates when the protrusions are fixedly received in the indentations in the tubular body for suspending the ceiling lamp.

However, there is not any stopper to prevent the protrusions moved back from the indentation so that the protrusion should be easily detached from the tubular body due to a force opposite to the assemble direction.

The present invention has arisen to mitigate and/or obviate the disadvantages of the conventional suspension device for a ceiling lamp.

SUMMARY OF THE INVENTION

The main objective of the present invention is to provide an improved suspension device for a ceiling lamp.

To achieve the objective, the suspension device for a ceiling lamp in accordance with the present invention comprises a tubular body connected to a base member of the ceiling lamp and a shaft having a first end received in the tubular body and a second end connected to a lamp set. A through hole is defined in the tubular body and two P-shaped channel defined in an inner periphery of the through hole. Two blocking plates are located in the P-shaped channel. Two protrusions are diametrically extending from the shaft and selectively engaged between the two blocking plates to hold the shaft in place in the tubular body.

Further benefits and advantages of the present invention will become apparent after a careful reading of the detailed description with appropriate reference to the accompanying drawings.

DETAILED DESCRIPTION OF THE INVENTION

Figure 1:
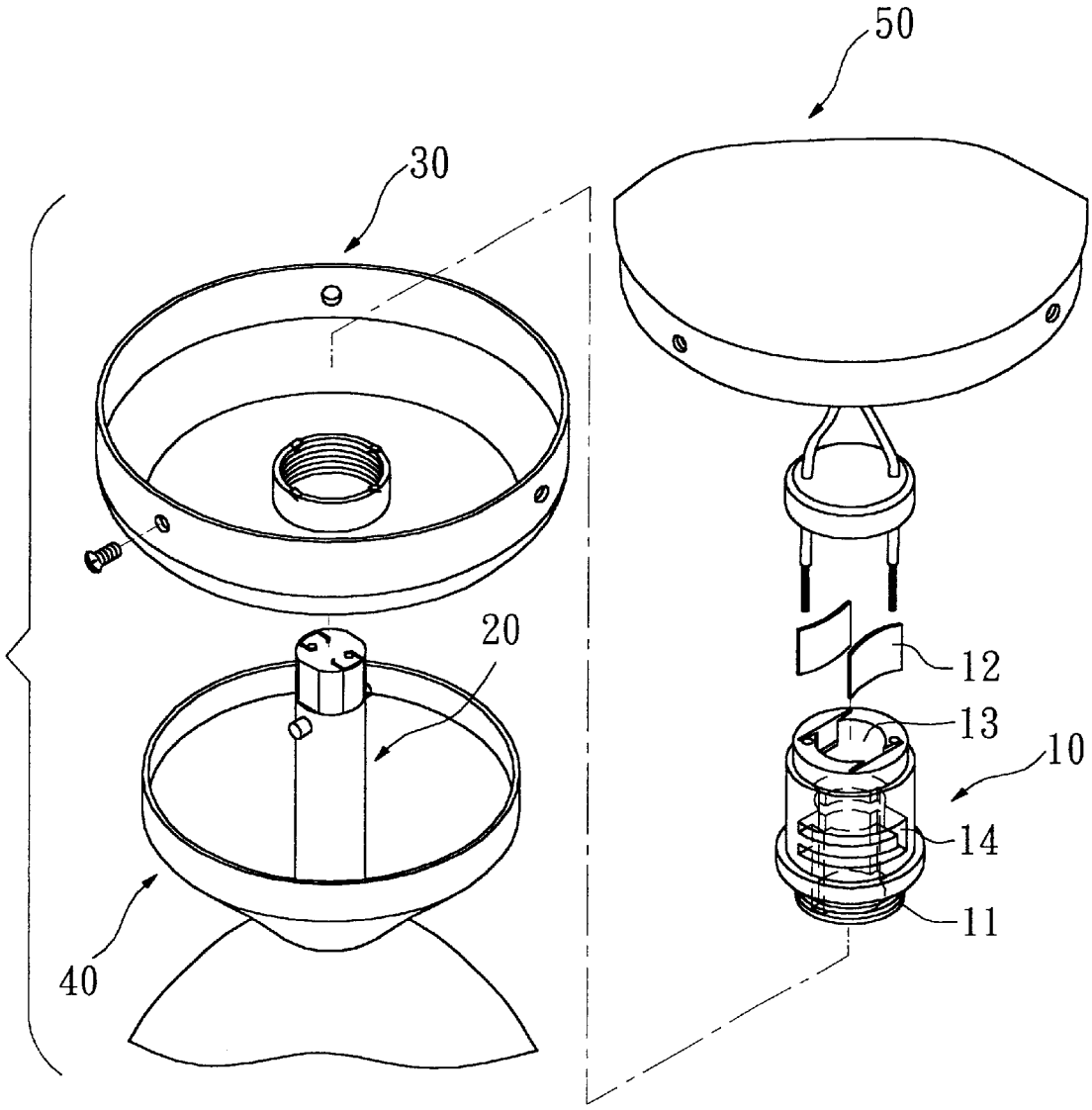
FIG. 1 is an exploded perspective view of a suspension device for a ceiling lamp in accordance with the present invention.
Figure 2C:
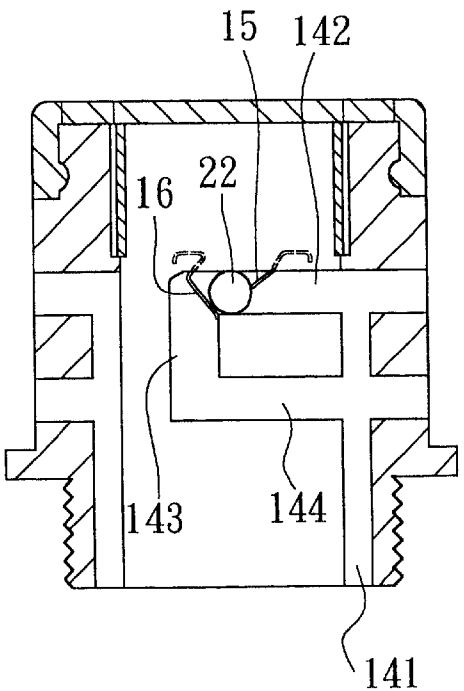
FIG. 2C is cross-sectional plan view of the tubular body along line C—C in FIG.2A.
Figure 2B:
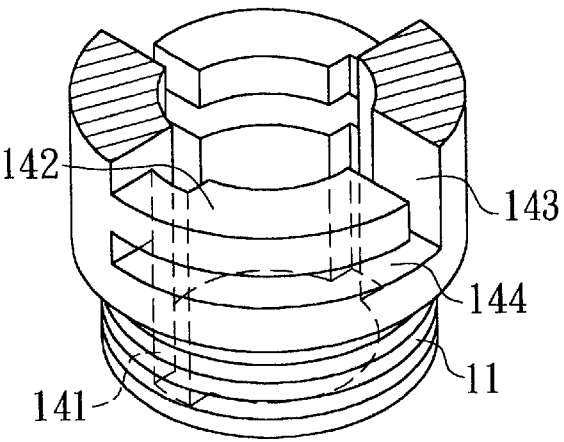
FIG. 2B is a perspective of the tubular body in partial section.
Figure 2A:
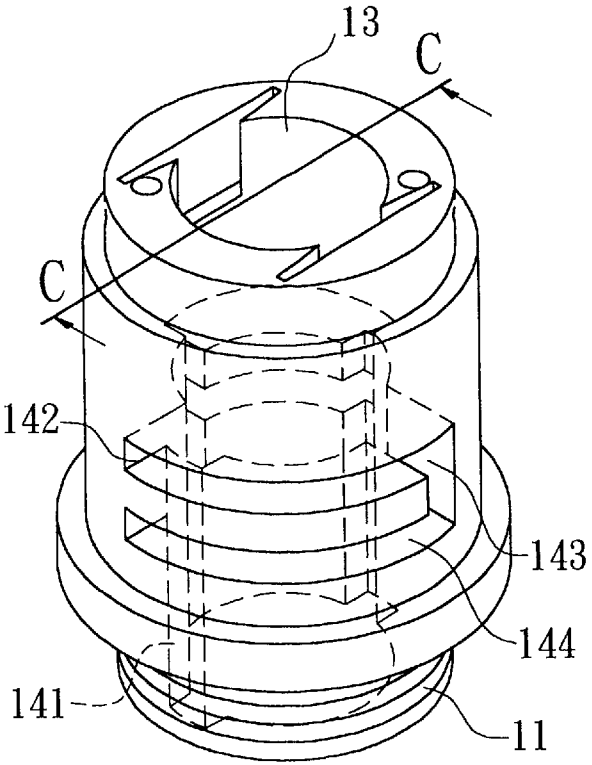
FIG. 2A is a perspective view of a tubular body of the suspension device in FIG. 1.
Figure 6:
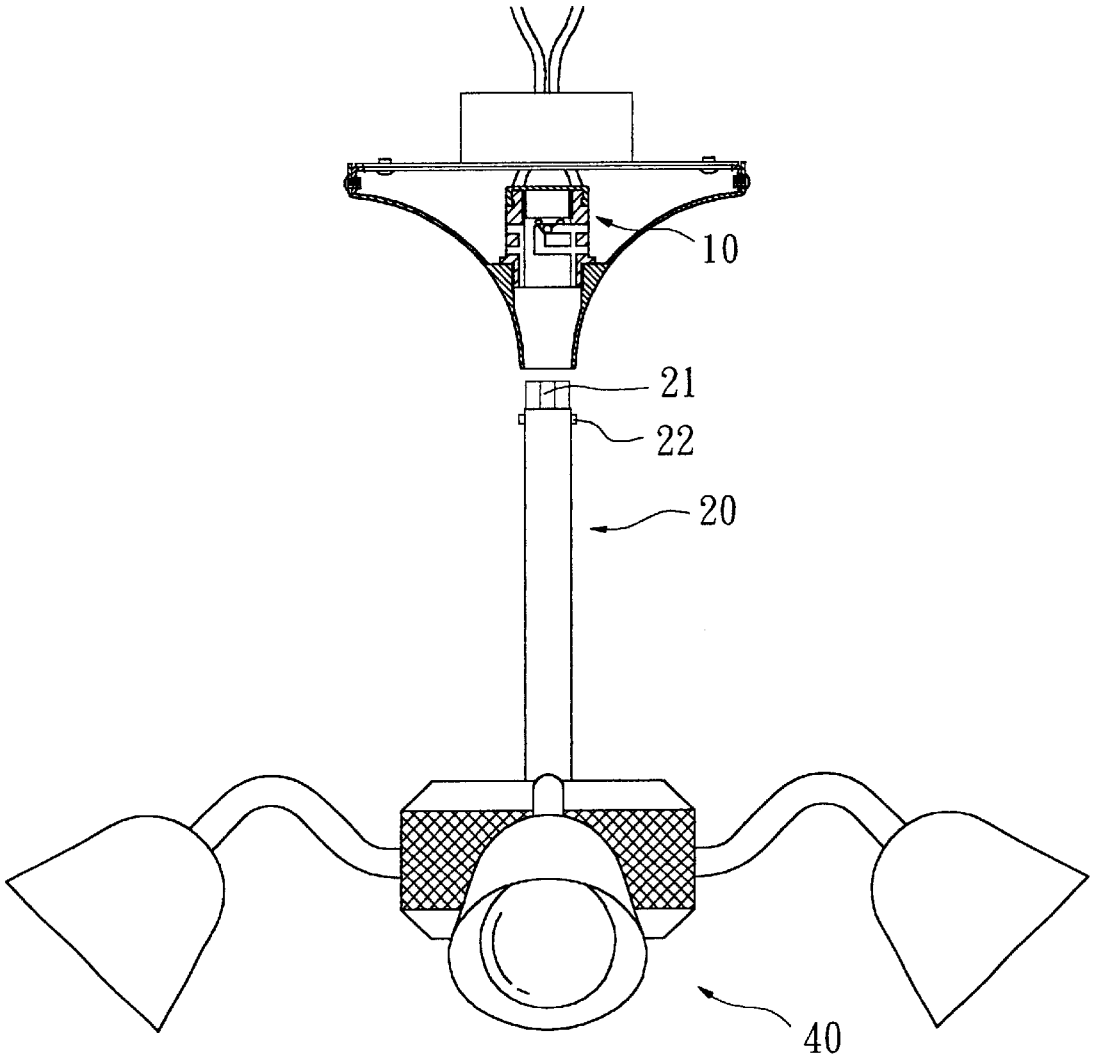
FIG. 6 is schematic view of the suspension device in FIG. 1.

Referring to the drawings and initially to FIGS. 1–2C and 6, a suspension device for a ceiling lamp in accordance with the present invention comprises base member (30) adapted to be secured on a frame (50) that is adapted to be mounted on the ceiling or a bottom of a motor of a ceiling fan, a tubular body (10) centrally mounted on the base member (30) and a shaft (20) including a first end secured in the tubular body (10) and a second end adapted to be connected to a lamp set (40).

The tubular body (10) includes a bottom mounted in the base member (30) and a through hole (13) longitudinally centrally defined in the tubular body (10). In the preferred embodiment of the present invention, a threaded portion (11) is formed on the bottom of the tubular body (10) and screwed into the base member (30) for securing the tubular body (10) on the base member (30). Two electrode plates (12) are inserted into a top of the tubular body (10) and electrically connected to a power source. The two electrode plates (12) partially extends into the through hole (13) and diametrically correspond to each other. The two P-shaped channels (14) are defined in an inner periphery of the through hole (13) and diametrically correspond to each other. Each P-shaped channel (14) has a first section (141) being parallel to an axis of the through hole (13) and extending to the bottom of the tubular body (10). A second section (142) is defined in the inner periphery of the through hole (13). The second section (142) has a first end perpendicularly communicating with the first section (141) and a second end opposite to the first end of the second section (142). A third section (143) defined in the inner periphery of the through hole (13). The third section (143) has a first end communicating with the second end of the second section (142) and a second end extending toward the threaded portion (11). A fourth section (144) defined in the inner periphery of the through hole (13). The fourth section (144) has a first end communicating with the second end of the third section (143) and a second communicating with the first section (141) of the P-shaped channel (14). In the preferred embodiment of the present invention, the first section (141) is parallel relative to the third section (143) and the second section (142) is parallel relative to the fourth section (144). The tubular body (10) includes a first blocking plate (15) with a first end securely received in the tubular body (10) and a second end extending into the P-shaped channel (14), and a second blocking plate (16) with a first end securely received in the tubular body (10) and a second end extending into the P-shaped channel (14). The second blocking plate (16) is disposed between the second section (142) and the third section (143). In the preferred embodiment of the present invention, the second end of the first blocking plate (15) extends toward the third section (143) of the P-shaped channel (14) and forms an approximately V-shape with the second blocking plate (16). The first blocking plate (15) has an elasticity smaller than that of the second blocking plate (16).

The shaft (20) has two electrode poles (21) diametrically mounted in the first end of the shaft (20) and abutting the two electrode plates (12) of the tubular body (10) when the present invention is assembled. The shaft (20) includes two protrusions (22) extending from an outer periphery of the shaft (20) and diametrically corresponding to each other. The two protrusions (22) is received in the second section (142) of the P-shaped channel (14) and secured between the first blocking plate (15) and the second blocking plate (16) such that the shaft (20) is partially secured in the tubular body (10) when the present invention is assembled. Two electric cords (not shown) are received in the shaft (20). Each electric cord has a first end electrically connected to a corresponding one of the two electrode poles (21) and a second end previously electrically connected to a switch (not shown) of the lamp set (40) for controlling the lamp set (40).

Figure 3:
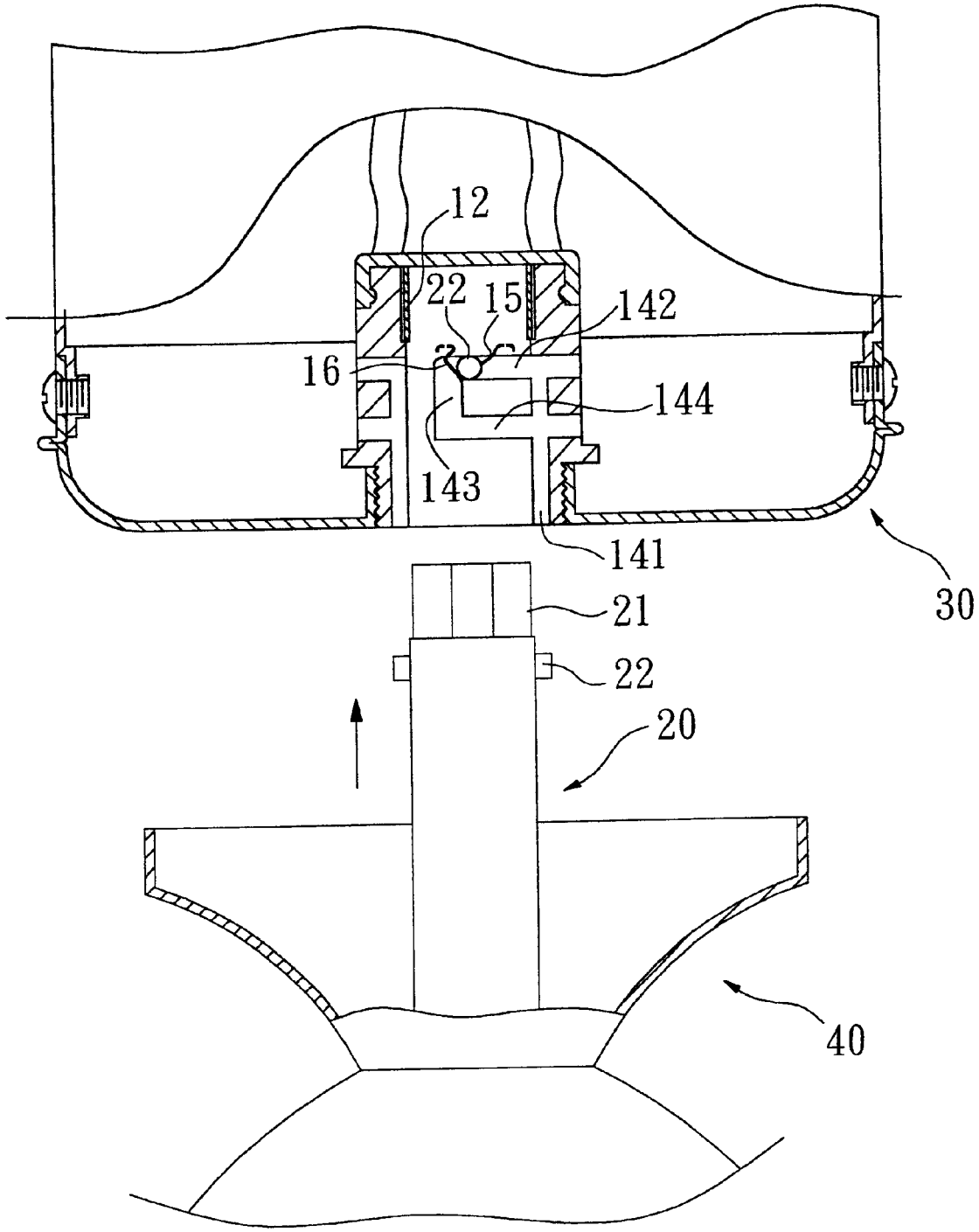
FIG. 3 is a side plan view of the suspension device in FIG. 1.
Figure 4:
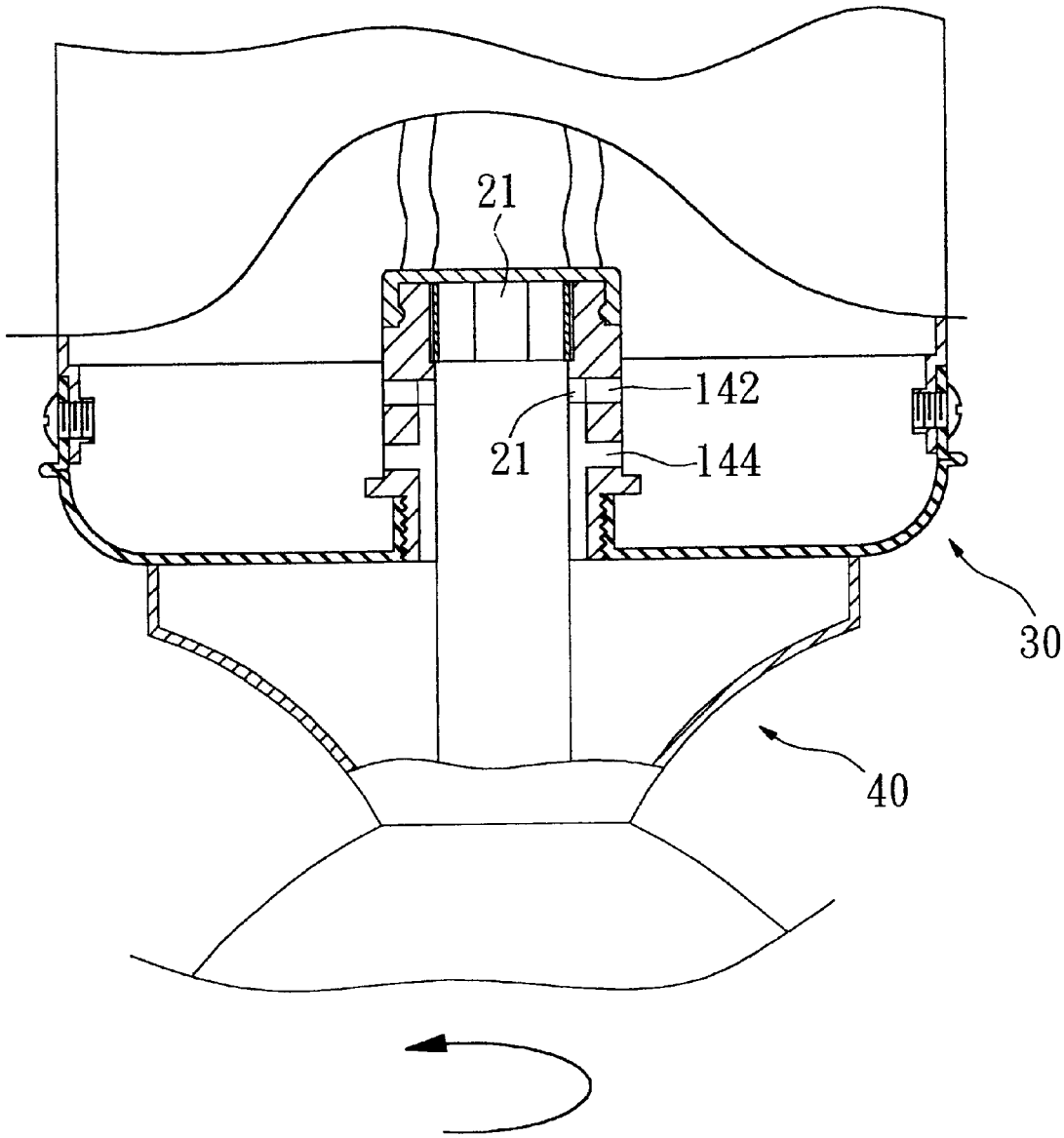
FIG. 4 is an operational side plan view of the suspension device in FIG. 1.
Figure 5:
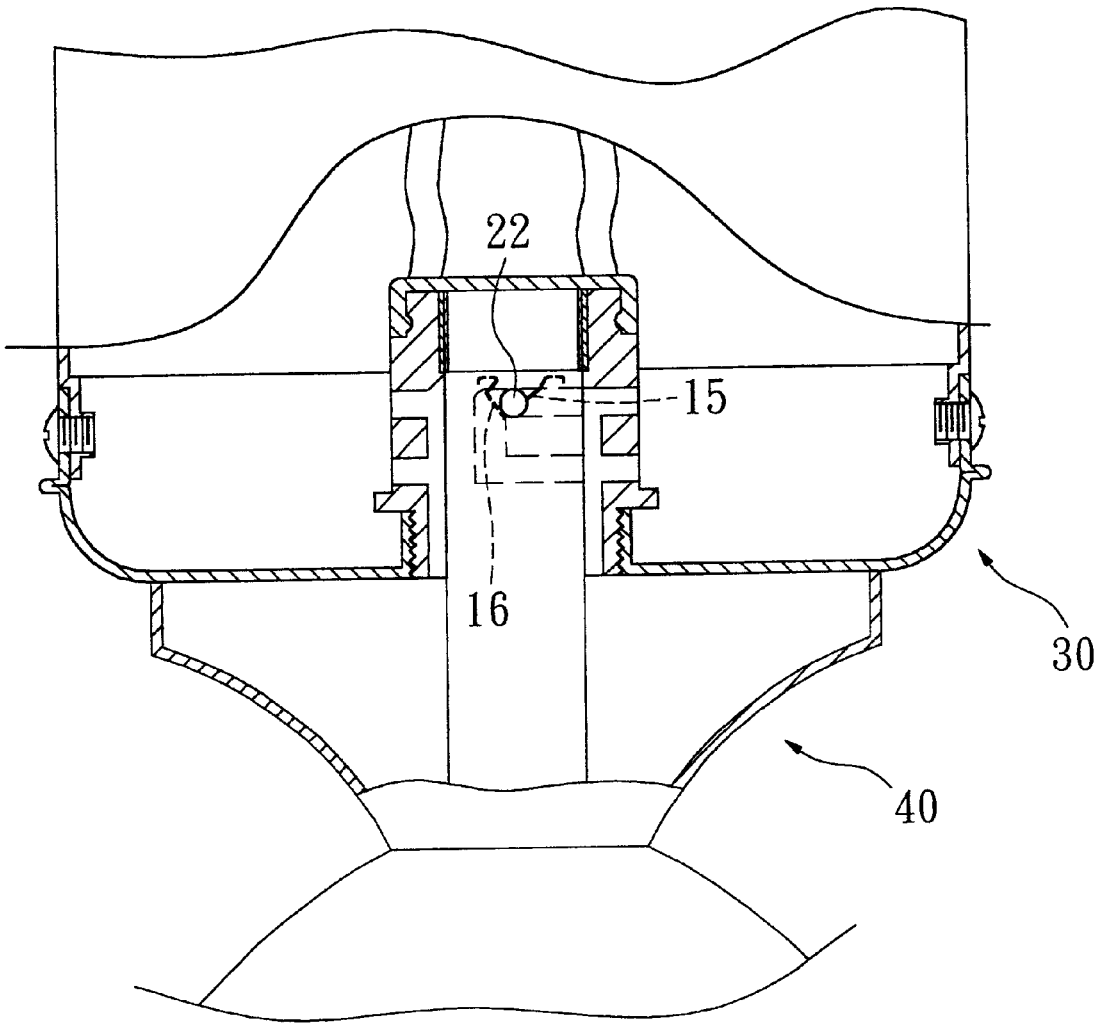
FIG. 5 is a side plan view of the suspension device in FIG. 1 when the protrusion is fixed in the channel in the tubular body.

With reference to FIGS. 3-6, to assemble the present invention, the base member (30) is mounted to the frame (50) after the tubular body (10) being screwed onto the base member (30) and the power source on the ceiling being electrically connected to the electrode plates (12). The first end of the shaft (20) is inserted into the through hole (13) in the tubular body (10) and the protrusions (22) are moved along the first section (141) of the P-shaped channel (14). The shaft (20) is turned to make the two protrusions (22) moved along the second section (142) after the two protrusions (22) being moved to align with the second section (142) of the P-shaped channel (14). The protrusions (22) will upwardly push the first blocking plate (15) and located between the first blocking plate (15) and the second blocking plate (16) when the protrusions (22) passes over the first blocking plate (15). The protrusion (22) cannot push down the second blocking plate (16) when passing over the first blocking plate (15) because the second blocking plate (16) has an elasticity greater than that of the first blocking plate (15). The protrusion (22) is never moved back to the first section (141) along the second section (142) after passing over the first blocking plate (15) because the first blocking plate (15) extends toward the third section (143).

To disassemble the lamp set (40). The shaft (20) is turned and downward pulled to make the protrusion (22) downward pushing the second blocking plate (16). The protrusion (22) is moved to the fourth section (144) along the third section (143) when the protrusion (22) passed over the second blocking plate (16). Then the protrusion (22) can be moved back to the first section (141) along the fourth section (144) when the shaft is backward turned. The shaft (20) is downward moved for detaching from the tubular body (10) when the protrusion (22) is moved to the first section (141) along the fourth section (144).

As described above, the suspension device for a ceiling lamp in accordance with the present invention has been advantageously altered and arisen to mitigate and/or obviate the disadvantages of the conventional suspension device for a ceiling lamp.

Although the invention has been explained in relation to its preferred embodiment, it is to be understood that many other possible modifications and variations can be made without departing from the spirit and scope of the invention as hereinafter claimed.

What is claimed is:

1. A suspension device for a ceiling lamp, comprising:

a tubular body including:

a lower end adapted to be mounted to a base member of the ceiling fan;

an upper end having two electrode plates inserted into the upper end of the tubular body, the two electrode plates diametrically corresponding to each other;

a through hole longitudinally and centrally defined in the tubular body and having an inner periphery, the two electrode plates partially extending into the inner periphery of the through hole;

two P-shaped channels defined in the inner periphery of the through hole and diametrically corresponding to each other, each channel having a first section parallel to an axis of the through hole, a second section perpendicularly communicating with the first section, a third section extending toward the lower end of the tubular body and communicating with the second section and a fourth section communicating with the third section and the first section, wherein the second section has a height higher than that of the fourth section relative to the lower end of the tubular body;

a first blocking plate secured in the second section and extending toward the third section; and a second blocking plate secured between the second section and the third section, the second blocking plate having an elasticity greater than that of the first blocking plate; and a shaft connected to the tubular body and including:

a first end rotatably and movably received in the through hole in the tubular body;

a second end adapted to be connected to a lamp set of the ceiling lamp;

two electrode poles inserted into the first end of the shaft and partially extending to an outer periphery of the shaft, the two electrode poles diametrically corresponding to each other; and two protrusions respectively radially extending from the outer periphery of the shaft and each moved in a corresponding one of the two P-shaped channels, the two protrusions diametrically corresponding to each other, each protrusion selectively engaged between the first blocking and the second blocking plate to hold the shaft in place in the tubular body, each electrode pole electrically abutting a corresponding one of the two electrode plates when the protrusion is engaged between the first blocking plate and the second blocking plate.

2. The suspension device for a ceiling lamp as claimed in claim 1, wherein the first section is parallel to the third section and the second section is parallel to the fourth section.

3. The suspension device for a ceiling lamp as claimed in claim 2, wherein the first blocking plate and the second blocking plate form a V-shape.

4. The suspension device for a ceiling lamp as claimed in claim 2, wherein a threaded portion is formed on the second end of the tubular body such that the tubular body is adapted to be screwed onto the base member of the ceiling lamp.

5. The suspension device for a ceiling lamp as claimed in claim 3, wherein a threaded portion is formed on the second end of the tubular body such that the tubular body is adapted to be screwed onto the base member of the ceiling lamp.

* * * * *